US006581774B1

(12) United States Patent
Galafassi et al.

(10) Patent No.: US 6,581,774 B1
(45) Date of Patent: Jun. 24, 2003

(54) FOLDING KNIFE BLOCK APPARATUS

(75) Inventors: Antonio Jose Galafassi, Houston, TX (US); Kevin Scott Perkins, Cypress, TX (US)

(73) Assignee: Tramontine USA, Inc., Sugar Land, TX (US)

( * ) Notice: Subject to any disclaimer, the term of this patent is extended or adjusted under 35 U.S.C. 154(b) by 0 days.

(21) Appl. No.: 09/711,453

(22) Filed: Nov. 13, 2000

(51) Int. Cl.[7] ..... B65D 6/04; A47F 7/00

(52) U.S. Cl. ..... 206/553; 206/379; 206/45.2; 211/70.7

(58) Field of Search ..... 206/553, 371–372, 206/373, 379, 45.2, 45.23, 45.24, 207, 576, 349, 736, 747, 756, 759, 763, 765; 211/70.7, 70.6, 69, 60.1

(56) References Cited

U.S. PATENT DOCUMENTS 1,378,363 A * 5/1921 List ..... 206/45.23
1,666,668 A * 4/1928 Purchas ..... 206/553
1,720,274 A * 7/1929 Holden ..... 206/270
3,926,419 A 12/1975 Kenny ..... 269/16
4,065,115 A 12/1977 Popeil et al. ..... 269/16
4,077,685 A 3/1978 Scire et al. ..... 312/246
4,573,569 A * 3/1986 Parker ..... 206/1.7
4,666,036 A * 5/1987 Bourbon ..... 206/425
4,930,628 A * 6/1990 Bridges ..... 206/45.23
4,979,610 A * 12/1990 Thomas ..... 206/749
D317,551 S 6/1991 King ..... D7/638
5,312,178 A 5/1994 King ..... 312/140
5,372,249 A * 12/1994 Grange ..... 206/349
5,382,009 A 1/1995 Mertz et al. ..... 269/16
D357,847 S 5/1995 Hoffman ..... D7/698
D382,775 S 8/1997 Skerker et al. ..... D7/638
5,732,820 A * 3/1998 Tsai ..... 206/369
5,775,499 A * 7/1998 Budert ..... 206/375
5,850,784 A 12/1998 Conner ..... 99/485
6,050,409 A * 4/2000 Delbeck et al. ..... 206/375
6,131,740 A * 10/2000 Huang ..... 206/759
6,283,291 B1 * 9/2001 Vasudeva et al. ..... 206/373

* cited by examiner

*Primary Examiner*—J. Mohandesi
(74) *Attorney, Agent, or Firm*—Conley Rose, P.C.

(57) ABSTRACT

A knife block to store and protect sharpened kitchen knives is suggested. The knife block includes a base and a pivotable tray connected together by a adjustable coupling system. The base includes a plurality of apertures therein that are to receive the blades of sharpened kitchen knives. The pivotable tray is configurable to change the geometry and functionality of the knife block from a folded configuration to a straight configuration. In the folded configuration, the knife block is easily deployed upon a counter top in an upright position. In the straight configuration, the knife block can be deployed upon a horizontal or vertical surface, for example upon a wall or within a drawer.

16 Claims, 3 Drawing Sheets

Fig. 1
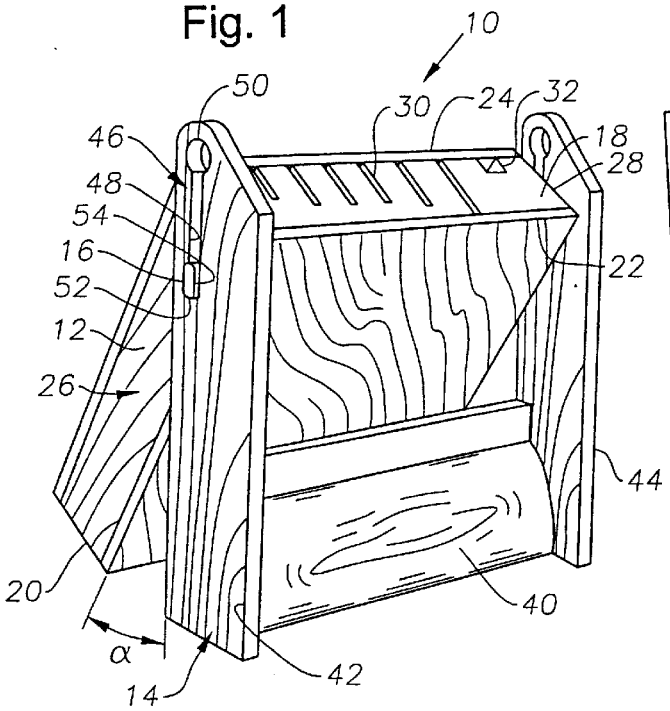
Fig. 3
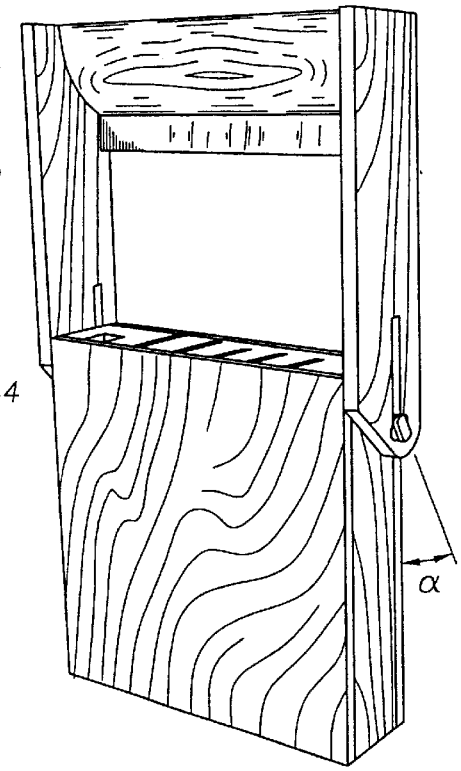
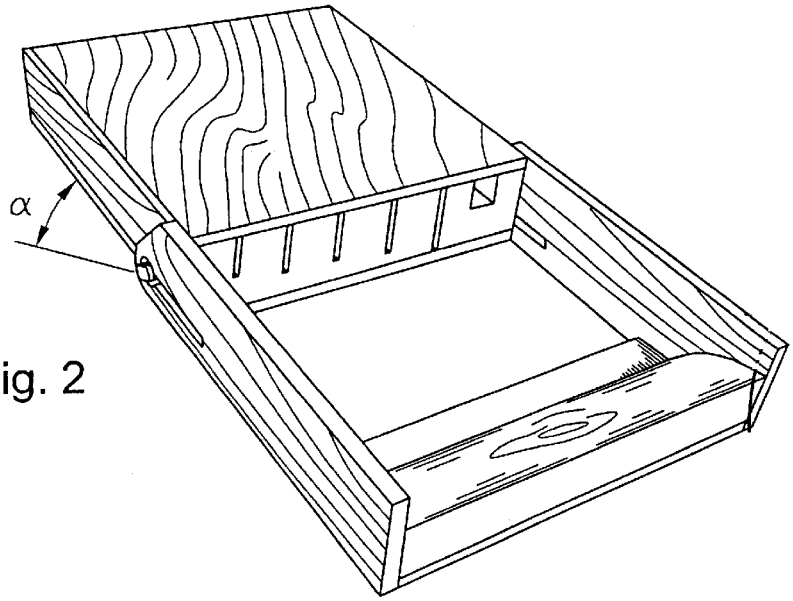
Fig. 2

FOLDING KNIFE BLOCK APPARATUS

CROSS-REFERENCE TO RELATED APPLICATIONS

Not Applicable.

TECHNICAL FIELD OF THE INVENTION

The present invention relates generally to a device to secure and store sharpened kitchen utensils when they are not in use. More particularly, the present invention refers to a device to secure and store sharpened kitchen utensils that is convertible from one configuration to another. More particularly still, the present invention relates to a knife block assembly that is easily adapted for use in a drawer, on a counter, or upon a wall.

BACKGROUND OF THE INVENTION

Knife blocks are traditionally used in kitchens to secure and store sharp kitchen cutting as, tools and their accessories. It is preferred to keep sharpened knives stored away in such devices for several reasons. First, because the knife is sharpened, it is preferred to be kept secure and out of the way for the purpose of safety. If left on a counter or simply tossed in a drawer, a sharpened knife has the potential to cut an unsuspecting person who may come in contact with the blade of the knife. Furthermore, it is desired to keep the sharpened edges of any knives away from small children. Second, it is preferable to store a knife within a knife block to prevent premature dulling of the sharpened edge. Knife edges can become dull if they are struck or bent through repeated contact with other objects. The sharpened edge of a knife will dull gradually over time on its own, through atmospheric conditions or its own physical property limits but this dulling pales in comparison to the amount of dulling that can occur through misuse or excessive wear. The knife block is a device to limit the dulling of a knife as much as possible while providing a save and secure location to reduce the chance of injury to children and those who may otherwise come into contact with the sharpened edge accidentally.

A traditional knife block is preferably formed out of a block of wood. The type and composition of the wood is largely unimportant and is usually selected by visual appeal rather than by utility. Other materials may also be selected for a knife block including, but not limited to, plastics, composites, and some metals. Since it is expected that the edge of the knife to be stored within the block may come into contact with the block itself, it is preferable for the material of the block to be softer than the blade material. A relatively small hardness value for the block material prevents the knife from becoming dulled through the simple engagement and removal cycles of the knife to and from the block over time.

In some situations, primarily for aesthetic purposes only, it is desired to provide a knife block constructed of a hard material such as steel, glass, etc. In this circumstance, the block can be manufactured from the hard material with a relatively soft lining material incorporated wherever the knife edge may come into contact with the block. This type of construction enables the block to be constructed of a relatively hard material without losing the edge-saving qualities of a relatively soft block construction.

One unfavorable aspect of most of the knife blocks currently available on the market today is their predominant bulk and weight. Most knife blocks on the market today are massive objects that require a lot of counter space. Unfortunately, with the advent of various new kitchen devices, counter space is at a high premium. Additionally, many homes do not have sufficient counter space for even the smallest of knife blocks. Because of this lack of space, sharpened knives are often stored loose in drawers and kept with other miscellaneous utensils. This is not preferred because the movement and interaction of the sharpened knives with respect to other utensils causes premature dulling. Furthermore, the risk of someone cutting themselves on a knife that has been randomly placed within a drawer is high.

To conserve counter space, various knife holders have been suggested, particularly those designed to be mounted upon a wall or stored within a drawer. While these knife holders offer counter space saving options, they cannot replicate the utility of a countertop knife block. Drawer based systems require that the drawer in question be opened and closed repeatedly each time it is necessary to retrieve or return a knife. It is impractical to expect the user to keep the drawer open throughout the food preparation operations because open drawers present further hazards. Wall-mounted knife storage solutions are not always practical because the food preparation may need to be performed in a location that is not within easy reach of the block. The wall-mounted solution presents the added hazard that a user .may have to travel certain distances with an unsheathed knife, thus increasing the risk of injury. A knife block assembly that addresses limits on kitchen storage space without sacrificing utility is highly desirable.

The present invention addresses the shortcomings of the prior art.

SUMMARY OF THE INVENTION

The present invention overcomes the deficiencies of the prior art by providing a re-configurable knife block assembly. A preferred embodiment is suggested that includes a base and a swivel that rotates and slides about a pair of dowels upon the base. The base includes cutout slots for the knives and accessories while the tray swivels and slides upon the dowels to arrange the block in either a folded or flat configuration. The flat configuration of the knife block allows a set of knives to be safely and securely stored out of the reach of small children upon a wall or within a drawer, while the folded configuration allows the convenience of traditional countertop access. The preferred embodiment of the present invention is easily and quickly switched from one configuration to another, allowing improved flexibility and ease of use to the end user.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

BRIEF DESCRIPTION OF THE DRAWINGS

For a more detailed description of the preferred embodiment of the present invention, reference will now be made to the accompanying drawings, wherein:

FIG. 1 is a perspective view drawing of a knife block in accordance with a preferred embodiment of the present invention in a countertop configuration;

FIG. 2 is a perspective view drawing of the knife block of FIG. 1 in a drawer configuration;

FIG. 3 is a perspective view drawing of the knife block of FIG. 1 in a wall-mount configuration;

DETAILED DESCRIPTION OF THE PREFERRED EMBODIMENTS

Figure 4A:
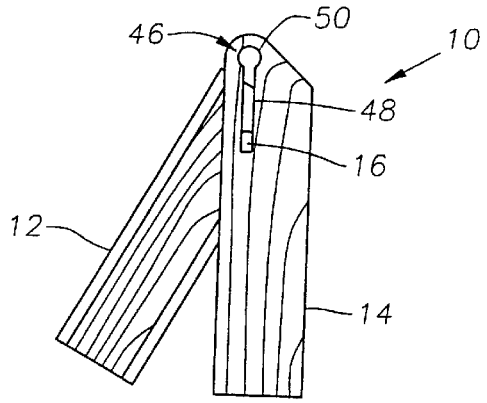
FIGS. 4*a*–4*f* are a series of schematic representations of a knife block in accordance with a preferred embodiment of the present invention, showing conversion from a countertop configuration of FIG. 1 to the wall-mount configuration of FIG. 3.

Referring initially to FIG. 1, a knife block 10 in accordance with a preferred embodiment of the present invention is shown in a countertop configuration. Knife block 10 includes a base 12, and a tray (or guard) 14, coupled together by pivot dowels 16. Base 12 includes a top 18, a bottom 20 and two pair of opposite sides 22, 24 and 26, 28. A plurality of cavities including slots 30 and square cut channel 32 extend through top 18 and through base 12 towards bottom 20 and generally define a longitudinal axis. Cavities 30, 32 preferably extend through base 12 in a substantially parallel arrangement. Although a variety of materials are acceptable, base 12 is preferably manufactured from wood, with the specific type of wood depending on consumer preference. In the preferred embodiment shown, pivot dowels 16 are rigidly attached to base 12 and extend outwardly from sides 26 and 28 near top 18.

Guard tray 14 includes an end panel 40 and a pair of substantially parallel legs 42, 44, that define a guard axis and each of which includes a guide slot 46 to receive pivot dowels 16. Each guide track 46 is preferably constructed as an elongated slot 48 with a circular hole 50 at the slot end that is farthest from end panel 40. End panel 40 connects legs 42, 44 together and stabilizes the structure of tray. Tray end 40 is shown in FIGS. 1–3 with a curved profile to facilitate the installation and removal of sharpened knives from block 10 by allowing clearance of their respective handles, but can be configured in a variety of desired shapes.

Pivot dowels 16 are preferably define a pivot axis therebetween and are constructed with a truncated cylindrical profile that includes arcuate portions 52 and straight portions 54. This truncated cylinder profile is preferred because it allows pivot dowel 16 to both slide within a slot and rotate within a hole with little or no resistance. In the preferred embodiment shown, the dimensions and curvature of arcuate portions 52 correspond to the diameter and curvature of circular hole 50 of track 46, while straight portions 54 correspond to the width of elongated slot 48. This arrangement allows each pivot dowel 16 and base 12 attached thereto to slide and rotate with respect to tray 14 into an assortment of positions as dictated by the geometry of track 46.

In the countertop position shown in FIG. 1, pivot dowels 16 are positioned such that their straight portions 54 are aligned with slot 48 and engaged completely within track 46. This position places tray 14 squarely upon the counter surface, leaving base 12 fixedly arranged behind tray 14 upon countertop at an angle a, dictated by the relative position of straight portions 54 to base 12. A preferred value for angle a is determined by taking into account the mass and center of gravity of base 12 so as to ensure that when tray 14 is positioned with respect to base 12 at $\alpha$ as shown, knife block assembly 10 is stable and will not tip over. Preferably, angle $\alpha$ is determined prior to manufacture so that the straight portions 54 of pivot dowels 16 can be affixed to base 12 at a corresponding angle.

Referring now to FIG. 2, the knife block assembly 10 is shown in a horizontal configuration that can be contained within a drawer. In the drawer position, base 12 and tray 14 of knife block 10 are horizontally aligned. Pivot dowel 16 is housed within the circular hole 50 of track 46 such that the circular portions 52 abut the inside of hole 50. Because each dowel 16 has rotated relative to slotted track 48 by an amount equal to the angle $\alpha$, dowel 16 cannot enter slot 48 and lateral movement relative to legs 42, 44 of tray 14 is prevented.

Referring now to FIG. 3, the knife block assembly 10 is shown in a vertical configuration that can be mounted upon a wall or other generally vertical surface. In the wall-mount position, base 12 and tray 14 are aligned vertically, much in the same manner as they were in the drawer configuration of FIG. 2. In this position, tray 14 is preferably fastened to the wall or vertical surface by a nail or hook (not shown), thus allowing base 12 to hang freely. Circular sections 52 of pivot dowel 16 engage circular hole 50 of track 46 to prevent base 12 from displacing away from legs 42, 44 of tray.

Figure 4B:
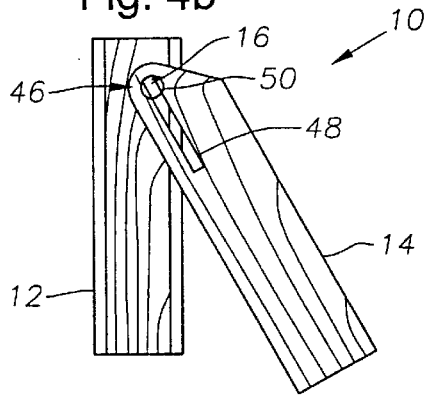
Figure 4C:
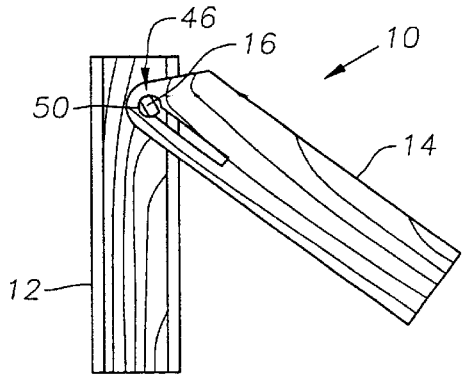
Figure 4D:
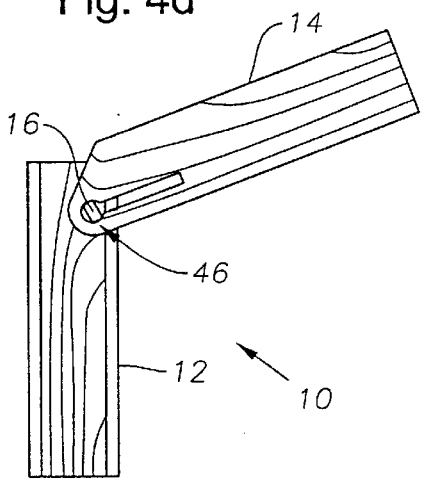
Figure 4E:
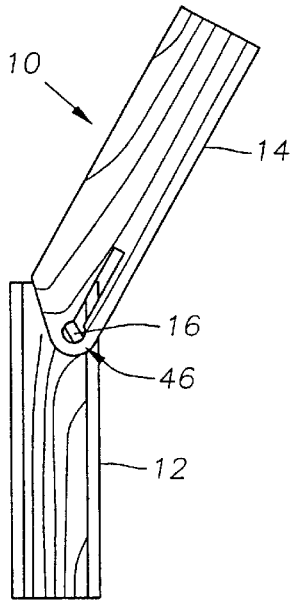
Figure 4F:
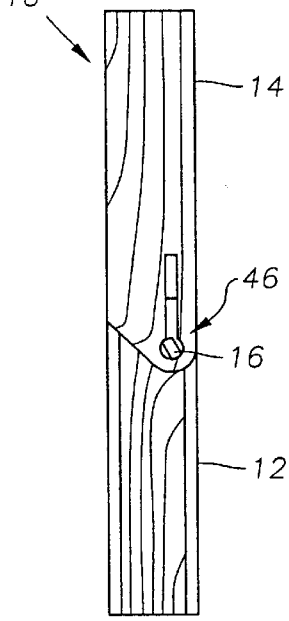

Referring now to FIGS. 1–3 collectively along with FIGS. 4*a*–4*f* the operation to convert knife block 10 from the countertop (FIG. 1 and FIG. 4*a*) to the wall-mount (FIG. 3 and FIG. 4*f*) configuration can be described. Initially, in FIG. 4*a*, knife block 10 is at rest upon a counter top with pivot dowel 16 retained within the slotted portion 48 of track 46. Then, as shown in FIG. 4*b*, base 12 and tray 14 are repositioned with respect to each other to move pivot dowel 16 from slotted portion 48 to circular portion 50 of track 46. FIG. 4*c* shows tray 14 rotated with respect to base 12 whilst pivot dowel 16 is retained within circular portion 50 of track 46. FIGS. 4*d* and 4*e* show similar progressive rotation of tray 14 with respect to base 12 until a wall-mount configuration is achieved in FIG. 4*f*. Once knife block 10 is configured as shown in FIG. 4*f*, it can be mounted upon a wall (as detailed in FIG. 3) or placed within a drawer (as detailed in FIG. 2).

Figure 5A:
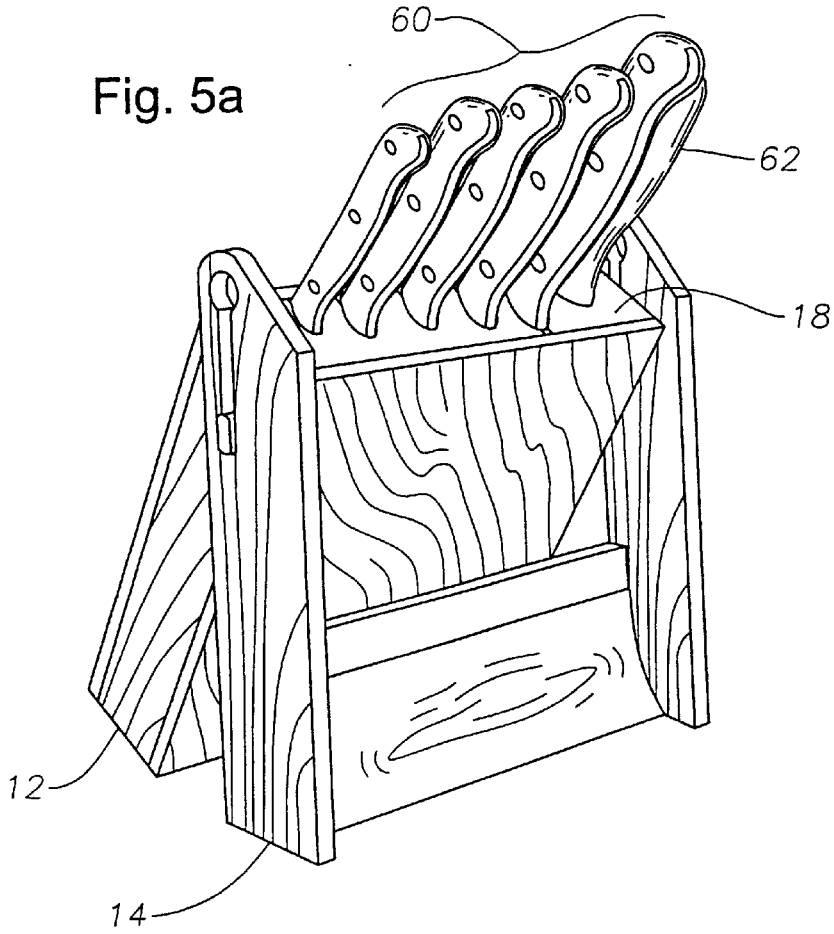
FIG. 5*a* is a perspective view drawing of the knife block of FIG. 1 in a countertop configuration with a plurality of knives and a sharpening tool installed therein.
Figure 5B:
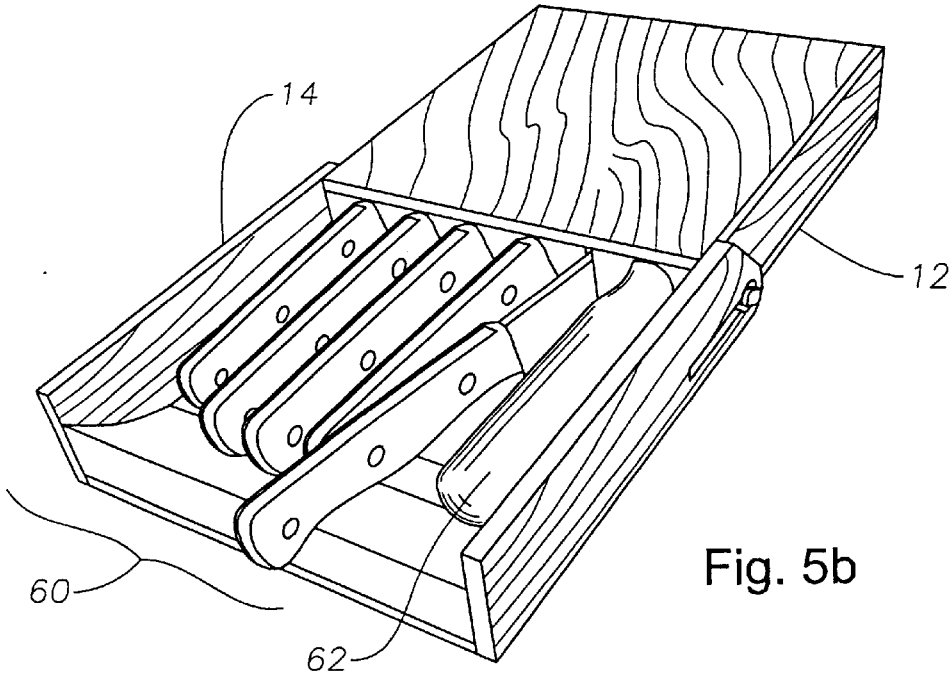
FIG. 5*b* is a perspective view drawing of the knife block of FIG. 2 in a drawer configuration with a plurality of knives and a sharpening tool installed therein.

Referring finally to FIGS. 5*a*–5*b* knife block 10 is shown in various configurations with a plurality of sharpened knives 60 and a sharpening tool 62 installed therein. Knives 60 are slidably engaged within slots (30 of FIG. 1) until their handles engage the top 18 of base 12. In a similar fashion, sharpening tool 62 is slidably engaged within the square cut channel (32 of FIG. 1) until it bottoms out. When a knife 60 or tool 62 is needed, the user can simply slidably remove it straight out of the countertop configuration of FIG. 5*a*, or lift the handle and slide it out in an upwardly fashion when in the configuration of FIG. 5*b*. When knife block 10 is in the wall-mount or horizontal position, knives 60 must be lifted out to remove them, thus providing an added measure of safety to passersby. Returning knives 60 or tool 62 is accomplished by reversing the steps taken to remove them.

Although it is preferred that knife block 10 of the preferred embodiment of the present invention be constructed primarily of wood, many other materials may be used. Wooden blocks 10 are preferred because of their low relative hardness compared to the sharpened edges to be contained within as they are less likely to dull or otherwise scratch the blades. Alternatively, the base 12 and tray 14 of knife block 10 may be manufactured of differing materials. Since tray 14 serves to protect the handles of knives and not the sharpened edge, the relative hardness preference need not apply. For example, tray 14 may be constructed of stainless steel whilst base 12 is constructed of a wooden material.

Viable alternatives to wooden compositions could include various plastics, composites and even some soft metals. As discussed above, it is even possible for materials harder than the blades of knives to be used if further steps are taken to protect their sharpened edges. Such steps could include softened inserts or alignment guides to keep knife and relatively hard block materials from coming into contact with each other.

The knife block shown in the preferred embodiment of the present invention offers a solution to issues of convenience, utility, and safety in the storage of sharpened kitchen utensils. With the block of the present invention stowed within a drawer or hung upon a wall, knives can be easily removed for use. Stowing the block of the present invention upon a wall or within a drawer enables the user to reduce countertop clutter and promote safety of small children or those who might otherwise hurt themselves. Additionally, if the user so desires, the block can be removed from the drawer or wall mount, reconfigured, and stood upon a countertop in a more traditional position. In the countertop position, utility of the knife block is maximized by allowing the user to quickly and easily remove and replace knives or utensils without having to open drawers or reach for a wall. When the cutting operations are complete, the knife block can be reconfigured to the drawer or wall-mount position and again stowed away for safety or convenience.

While a preferred embodiment of the invention has been shown and described, modifications thereof can be made by one skilled in the art without departing from the spirit of the invention.

What is claimed is:

1. A device to store and protect knives comprising:

a base block, said base block including a top surface and a plurality of cavities formed therein;

at least one knife, said knife including a handle with a first and second end and a cutting portion extending from said first end, said cutting portion being retained in one of said cavities of said base block;

a tray member having a pair of substantially parallel side members and a cross member interconnecting said side members, said tray member being coupled to said base block by a coupling system and moveable between a first position and a second position relative to said base block, said side members being substantially parallel to said base block when in the first position and forming an angle less than 180° with respect to said base block when in the second position; and wherein in the first position, said first end of said knife handle engages said top surface of said base block and said second end of said knife handle engages said cross member, wherein said top surface of said base block, said side members of said tray and said cross member collectively form an aperture such that said cutting portion of said knife can be slidingly removed in an upwardly fashion from said base block when said tray member is in the first position; and wherein said coupling system comprises a slotted keyway and a circular hole in the side members of said tray member.

2. The device of claim 1 wherein said coupling system further comprises a truncated cylinder that is slidably engagable within said slotted keyway and rotatably engagable within said circular hole.

3. The device of claim 2 wherein said truncated cylinder is attached to said base block.

4. The device of claim 2 wherein said truncated cylinder is attached to said tray member.

5. The device of claim 2 whereby said first position is achieved when said truncated cylinder is contained within said circular hole of said coupling.

6. The device of claim 2 whereby said second position is achieved when said truncated cylinder is contained within said slotted keyway of said coupling and said tray member is not rotatable relative to said base block.

7. The device of claim 1 wherein said base block comprises a material with a hardness property lower than that of said sharpened knives.

8. The device of claim 7 wherein said material is wood.

9. The device of claim 7 wherein said material is a polymer.

10. The device of claim 7 wherein said material is a composite.

11. The device of claim 1 wherein said tray comprises steel.

12. A knife block to store and protect sharpened knives comprising:

a plurality of knives, each knife including a handle with a first and second end and a cutting portion extending from the first end;

a base block including a top surface having a plurality of slotted apertures adapted to receive said knives;

a tray member having a pair of substantially parallel side members and a cross member and coupled to said base block by a coupling including a slotted keyway and a circular hole;

a truncated cylinder slidably engagable within said slotted keyway and rotatably engagable within said circular hole;

said tray member having a first position and a second position relative to said base block;

said tray member being substantially parallel to said base block when in the first position, wherein in the first position the second end of at least one of said knives engages said cross member such that the at least one of said knives can be slidingly removed in an upwardly fashion from said base block;

said tray member forming an angle less than 180° with respect to said base block when in the second position wherein said tray member is not rotatable relative to said base block in the second position enabling the knife block to be placed upon a counter to allow free access to the knives contained therein.

13. The knife block of claim 12 wherein said truncated cylinder is attached to said base block.

14. The knife block of claim 12 wherein said truncated cylinder is attached to said tray member.

15. The knife block of claim 12 whereby said first position is achieved when said truncated cylinder is contained within said circular hole of said coupling.

16. The knife block of claim 12 whereby said second position is achieved when said truncated cylinder is contained within said slotted keyway of said coupling such that said tray member is not rotatable relative to said base block.

* * * * *

UNITED STATES PATENT AND TRADEMARK OFFICE

CERTIFICATE OF CORRECTION

PATENT NO. : 6,581,774 B1 
DATED : June 24, 2003
INVENTOR(S) : Antonio Jose Galafassi and Kevin Scott Perkins It is certified that error appears in the above-identified patent and that said Letters Patent is hereby corrected as shown below:

Title page,
Item [73], should read -- [73] Assignee: Tramontina USA, Inc., Sugar Land, TX (US) --

Signed and Sealed this

Seventh Day of October, 2003

JAMES E. ROGAN
*Director of the United States Patent and Trademark Office*